US008715101B2

(12) United States Patent
Naruo et al.

(10) Patent No.: US 8,715,101 B2
(45) Date of Patent: May 6, 2014

(54) IRON GOLF CLUB

(71) Applicant: Mizuno Corporation, Osaka (JP)

(72) Inventors: Takeshi Naruo, Osaka (JP); Kazuya Ishida, Osaka (JP); Takashi Kimura, Osaka (JP); Yasuyuki Ohta, Osaka (JP); Tetsuya Kanayama, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 13/682,327

(22) Filed: Nov. 20, 2012

(65) Prior Publication Data

US 2013/0130824 A1 May 23, 2013

(30) Foreign Application Priority Data

Nov. 22, 2011 (JP) ..... 2011-255095

(51) Int. Cl.
*A63B 53/04* (2006.01)

(52) U.S. Cl.
USPC ..... 473/292

(58) Field of Classification Search
USPC ..... 473/292
See application file for complete search history.

(56) References Cited

U.S. PATENT DOCUMENTS

| | | | | |
|---|---|---|---|---|
| 5,297,791 | A | 3/1994 | Negishi | |
| 5,467,984 | A | 11/1995 | Veux et al. | |
| 5,569,097 | A * | 10/1996 | Veux et al. | 473/292 |
| 6,478,689 | B1 * | 11/2002 | Hisamatsu | 473/287 |
| 7,792,946 | B2 * | 9/2010 | Keyghobad et al. | 709/223 |
| 2002/0107089 | A1 | 8/2002 | Yamada | |
| 2002/0123392 | A1 | 9/2002 | Yamada | |
| 2007/0117647 | A1 | 5/2007 | Nakajima | |
| 2010/0041492 | A1 * | 2/2010 | Rice et al. | 473/289 |
| 2012/0129622 | A1 | 5/2012 | Naruo et al. | |

FOREIGN PATENT DOCUMENTS

| | | |
|---|---|---|
| JP | 06510437 | 11/1994 |
| JP | 10155952 | 6/1998 |
| JP | 10155952 A | 6/1998 |
| JP | H1199231 | 4/1999 |
| JP | 2001087434 | 4/2001 |
| JP | 2001120696 | 5/2001 |
| JP | 2001170232 | 6/2001 |

(Continued)

OTHER PUBLICATIONS

European Search Report dated Mar. 20, 2013 for application EP12193478.

(Continued)

*Primary Examiner* — Michael Dennis
(74) *Attorney, Agent, or Firm* — Troutman Sanders LLP; James E. Schutz; Robert R. Elliott, Jr.

(57) ABSTRACT

An iron golf club has a club length L measured in accordance with 60-degrees method of at least 36.5 inches, and it includes: a carbon shaft; a weight attached to said carbon shaft; a grip attached to one end of said carbon shaft; and a head attached to the other end of said carbon shaft. Sum total of mass of the carbon shaft, the weight, the grip and the head is at least 0.3996 kg and at most 0.4197 kg. A value r/L, where r represents a distance from an upper end of the grip to the center of gravity of the iron golf club, is at least 0.765 and at most 0.795. Thus, an iron golf club realizing improved easiness of swing can be provided.

5 Claims, 3 Drawing Sheets

(56) References Cited

FOREIGN PATENT DOCUMENTS

| | | | |
|---|---|---|---|
| JP | 2001286582 | | 10/2001 |
| JP | 2001286582 | A | 10/2001 |
| JP | 2007029701 | | 2/2007 |
| JP | 2011235024 | | 11/2011 |
| WO | 9307935 | | 4/1993 |

OTHER PUBLICATIONS

Notice of Grounds of Rejection dated Aug. 27, 2013 for related Japanese Patent Application 2011-255095.

* cited by examiner

IRON GOLF CLUB

This nonprovisional application is based on Japanese Patent Application No. 2011-255095 filed with the Japan Patent Office on Nov. 22, 2011, the entire contents of which are hereby incorporated by reference.

BACKGROUND OF THE INVENTION

1. Field of the Invention

The present invention relates to an iron golf club.

2. Description of the Background Art

For an iron golf club, controllability is of high importance. The controllability may be influenced by the easiness of swing of the iron golf club. Whether an iron golf club is easy to swing or not tends to be influenced by inertia moment of the iron golf club. Specifically, if an iron golf club becomes longer, the inertia moment becomes larger and, therefore, it become less easy to swing the iron golf club.

In view of the foregoing, by way of example, Japanese Patent Laying-Open No. 2001-286582 proposes a set of iron golf clubs enabling improved controllability by adjusting the inertia moment. In the iron golf club set described in this reference, inertia moment, of which fulcrum is at a position 170 mm from the rear end of a grip toward the front end of the shaft of the iron golf club, is adjusted. Further, between the rear end and the position 170 mm from the rear end of the grip toward the front end of the shaft of the iron golf club, a heavy substance is inserted.

It has been found that even if the inertia moment of iron golf club is adjusted simply by adding a heavy substance as in the iron golf club described in the reference above, easiness of swing of the iron golf club is not improved.

SUMMARY OF THE INVENTION

The present invention was made in view of the foregoing, and its object is to provide an iron golf club realizing improved easiness of swing.

The present invention provides an iron golf club, having a club length L measured in accordance with 60-degrees method of at least 36.5 inches, including: a carbon shaft; a weight attached to the carbon shaft; a grip attached to one end of the carbon shaft; and a head attached to the other end of the carbon shaft. Sum total of mass of the carbon shaft, the weight, the grip and the head is at least 0.3996 kg and at most 0.4197 kg. A value r/L, where r represents a distance from an upper end of the grip to the center of gravity of the iron golf club, is at least 0.765 and at most 0.795.

The 60-degrees method is a method of measuring length of a club, specified in the rule of Japan Golf Association. According to the definition of this method, when a club is placed on a horizontal plane and a 60-degree plane is set against the sole of the club, the length of the club is the distance from the intersecting point of these two planes to an upper end of the grip.

The mass of an iron golf club is a sum of mass of carbon shaft, weight, grip and head. A value r/L, that is, r representing the distance from the upper end of grip to the center of gravity of iron golf club divided by L representing the length of the club, is referred to as center-of-gravity-ratio.

Through intensive study, the inventors have found that an iron golf club can be improved to be easier to swing, by optimizing the mass and the center-of-gravity-ratio r/L of the iron golf club having a carbon shaft and a weight, with the iron golf club having the length of at least 36.5 inches. Specifically, easiness of swing of the iron golf club can be improved if the iron golf club has the mass of at least 0.3996 kg and at most 0.4197 kg and the value of center-of-gravity-ratio r/L is at least 0.765 and at most 0.795.

In the golf club above, preferably, the value r/L is at most 0.790. Thus, easiness of swing of the iron golf club can further be improved.

In the golf club above, preferably, equivalent pendulum length of the iron golf club with the upper end of the grip being an axis of rotation is at least 0.877 m and at most 0.890 m. The equivalent pendulum length is a value obtained by dividing the inertia moment by static moment. The inertia moment is given when the iron golf club is rotated with the grip upper end being the fulcrum. The static moment is a value obtained by multiplying the mass of iron golf club by the distance from the grip upper end to the center of gravity of the iron golf club.

Through intensive study, the inventors have found that the easiness of swing of the iron golf club can be improved when the equivalent pendulum length is at least 0.877 m and at most 0.890 m.

The iron golf club described above has club length L of at least 36.75 inches. Generally, the length of iron club No. 7 is 36.75 inches. The easiness of swing of an iron golf club tends to become a problem particularly in iron golf clubs of No. 7 and longer. With the club length set to be equal to or longer than 36.75 inches, the easiness of swing of iron golf clubs of No. 7 and longer, of which easiness of swing tends to be a problem, can be improved. Thus, easiness of swing can effectively be improved.

In the iron golf club described above, mass of the weight is at least 20 g and at most 40 g. Therefore, the easiness of swing of the iron golf club can be improved by optimizing the center-of-gravity-ratio r/L. Further, since the range of weight of the weight can be selected, degree of freedom in design can be improved.

As described above, the iron golf club in accordance with the present invention attains improved easiness of swing.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

In the following, an embodiment of the present invention will be described with reference to the figures.

First, the structure of iron golf club in accordance with the embodiment of the present invention will be described.

Figure 1:
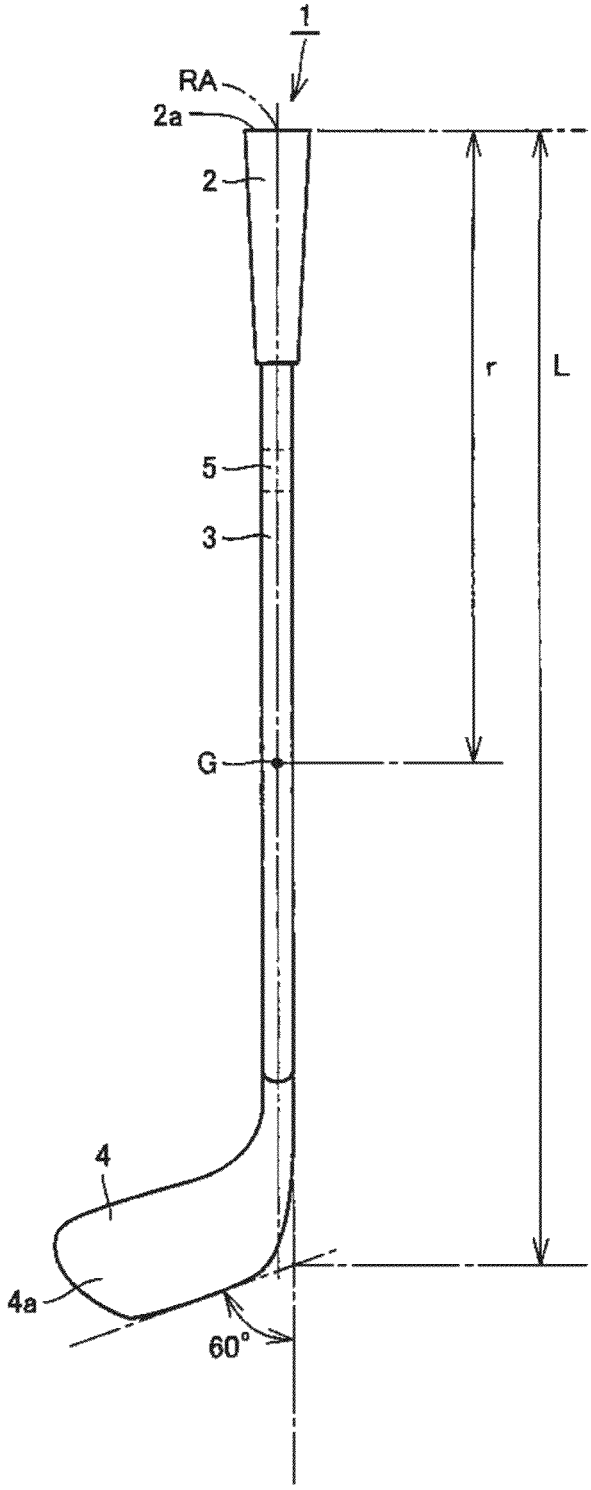
FIG. 1 is a schematic front view of an iron golf club in accordance with an embodiment of the present invention.

Referring to FIG. 1, an iron golf club 1 in accordance with an embodiment of the present invention is formed to have the length L, which is measured in accordance with the 60-degrees method, of at least 36.5 inches. Here, 36.5 inches is about 0.927 meters (m). The club length L may be 36.75 inches or longer. Here, 36.75 inches is about 0.933 meters (m).

Iron golf club 1 mainly includes a grip 2, a carbon shaft 3, a head 4 and a weight 5. Grip 2 is attached to one end of carbon shaft 3, and head 4 is attached to the other end of carbon shaft 3. Head 4 has a hitting face 4*a*. Weight 5 is attached to carbon shaft 3. Weight 5 is fixed on an inner circumferential surface, in the inner space of carbon shaft 3. Weight 5 may be fixed on an outer circumferential surface of carbon shaft 3.

The mass of grip 2, carbon shaft 3, head 4 and weight 5 is set such that the sum will be at least 0.3996 kg and at most 0.4197 kg. Further, the value r/L of center-of-gravity-ratio, obtained by dividing the distance r from the upper end 2*a* of grip 2 to the center of gravity G of iron golf club 1 by the length L of iron golf club is set to be at least 0.765 and at most 0.795. Preferably, the value r/L of center-of-gravity-ratio is at most 0.790.

In the embodiment of the present invention, based on actual swing analysis, the position of an axis of rotation RA as the center of rotation of iron golf club 1 is set to be the upper end 2*a* of grip 2. The upper end 2*a* of grip 2 substantially corresponds to the rear end of carbon shaft 3.

The equivalent pendulum length Lp (m) with the upper end 2*a* of grip 2 being the axis of rotation RA is a value obtained by dividing inertia moment I ($kg \cdot m^2$) around the upper end 2*a* of grip 2 by the mass m (kg) of iron golf club 1 and by the distance r (m) from the upper end 2*a* of grip 2 to the center of gravity G of iron golf club 1, and it is given by Equation (1) below.

$$Lp = I/(mr) \quad (1)$$

In iron golf club 1 in accordance with the embodiment of the present invention, the equivalent pendulum length Lp with the upper end 2*a* of grip 2 being the axis of rotation RA is set to be at least 0.877 m and at most 0.890 m.

The mass of weight 5 may be at least 20 g and at most 40 g. Weight 5 may be formed of tungsten-containing prepreg. In iron golf club 1, the distance r from the upper end 2*a* of grip 2 to the center of gravity G of iron golf club 1 can be adjusted by weight 5. Weight 5 is arranged on the side of grip 2. By reducing mass m of iron golf club 1 and by making shorter the distance r from the upper end 2*a* of grip 2 to the center of gravity G of iron golf club 1, inertia moment I can be made smaller.

In actual design, however, it is difficult to reduce the mass of head 4 from the viewpoint of strength. Therefore, it is difficult to reduce the mass of iron golf club 1. Therefore, in order to make shorter the distance r from the upper end 2*a* of grip 2 to the center of gravity G of iron golf club 1, weight 5 is arranged on the side of grip 2, as described above.

By way of example, weight 5 may be arranged in a range from at least 0.295 m to at most 0.400 m from the upper end 2*a* of grip 2. In this case also, the distance r from the upper end 2*a* of grip 2 to the center of gravity G of iron golf club 1 can be made shorter.

The functions and effects of iron golf club 1 in accordance with the embodiment of the present invention will be described.

Through intensive study, the inventors have found that easiness of swing of iron golf club 1 can be improved by optimizing the mass m and center-of-gravity-ratio r/L of iron golf club 1 having carbon shaft 3 and weight 5, with the club length L of at least 36.5 inches. Specifically, the easiness of swing of iron golf club 1 can be improved if the mass m of iron golf club 1 is at least 0.3996 kg and at most 0.4197 kg and the value of center-of-gravity-ratio r/L is at least 0.765 and at most 0.795.

In iron golf club 1 in accordance with the embodiment of the present invention, preferably, the value of center-of-gravity-ratio r/L is at most 0.790. With this value, the easiness of swing of iron golf club 1 can further be improved.

In iron golf club 1 in accordance with the embodiment of the present invention, it is preferred that the value Lp of the equivalent pendulum length with the upper end 2*a* of grip 2 being the axis of rotation RA is at least 0.877 m and at most 0.890 m. The equivalent pendulum length Lp is the value obtained by dividing inertia moment I by the static moment. Inertia moment I is given by rotating iron golf club 1 with the upper end 2*a* of grip 2 used as a fulcrum. Static moment is a value obtained by multiplying the mass m of iron golf club 1 by the distance from the upper end 2 of grip 2 to the center of gravity G of iron golf club 1.

Through intensive study, the inventors have found that the easiness of swing of iron golf club 1 can be improved when the length Lp of equivalent simple pendulum is at least 0.877 m and at most 0.890 m.

In iron golf club 1 in accordance with the embodiment of the invention, it is preferred that the club length L is at least 36.75 inches. Generally, the length of iron club No. 7 is 36.75 inches. The easiness of swing of an iron golf club tends to become a problem particularly in iron golf clubs 1 of No. 7 and longer. With the club length set to be equal to or longer than 36.75 inches, the easiness of swing of iron golf clubs of No. 7 and longer, of which easiness of swing tends to be a problem, can be improved. Thus, easiness of swing can effectively be improved.

In iron golf club 1 in accordance with the embodiment of the invention, it is preferred that the mass of weight 5 is at least 20 g and at most 40 g. Thus, the easiness of swing of iron golf club 1 can be improved, by optimizing the center-of-gravity-ratio r/L. Further, since the range of weight of weight 5 can be selected, degree of freedom in design can be improved.

EXAMPLES

In the following, examples of the present invention will be described. It is noted that the same or corresponding portions as those described above will be denoted by the same reference characters, and description thereof may not be repeated.

Iron golf clubs of Comparative Examples 1 to 5 and Examples 1 to 3 having such specifications as shown in Table 1 were fabricated. The reference characters shown in FIG. 1 correspond to the reference characters used in Table 1.

Iron golf clubs of Examples 1 to 3 and Comparative Example 5 have weights. Iron golf clubs of Comparative Examples 1 to 4 do not have weights. Iron golf clubs of Examples 1 to 3 and Comparative Examples 1, 2 and 4 have carbon shafts. Iron golf clubs of Comparative Examples 3 and 5 have steel shafts.

TABLE 1

| | m (kg) | w (Kg) | wl (m) | L (inch) | L (m) | r/L | r (m) | mr (kg · m) | Ig (kg · m$^2$) | I (kg · m$^2$) | I/mr (m) | Ave | Sensory best | Carbon best |
|---|---|---|---|---|---|---|---|---|---|---|---|---|---|---|
| Comparative Example 1 | 0.3684 | — | — | 37.94 | 0.964 | 0.801 | 0.772 | 0.284 | 0.0441 | 0.2636 | 0.927 | −0.015 | 1 | 2 |
| Comparative Example 2 | 0.3797 | — | — | 36.75 | 0.933 | 0.814 | 0.760 | 0.289 | 0.0410 | 0.2603 | 0.902 | 0.112 | 2 | 4 |
| Example 1 | 0.3996 | 20 | 0.295 | 36.75 | 0.933 | 0.790 | 0.737 | 0.295 | 0.0452 | 0.2622 | 0.890 | 0.511 | 4 | 6 |
| Example 2 | 0.3996 | 20 | 0.400 | 36.75 | 0.933 | 0.795 | 0.742 | 0.297 | 0.0436 | 0.2636 | 0.889 | −0.220 | 2 | 4 |
| Example 3 | 0.4197 | 40 | 0.295 | 36.75 | 0.933 | 0.765 | 0.714 | 0.300 | 0.0489 | 0.2629 | 0.877 | −0.173 | 2 | 2 |
| Comparative Example 3 | 0.4092 | — | — | 36.75 | 0.933 | 0.783 | 0.731 | 0.299 | 0.0459 | 0.2645 | 0.884 | 0.406 | 8 | — |
| Comparative Example 4 | 0.3599 | — | — | 36.50 | 0.927 | 0.826 | 0.766 | 0.276 | 0.0368 | 0.2479 | 0.899 | −0.621 | 1 | 1 |
| Comparative Example 5 | 0.4467 | 40 | 0.295 | 36.75 | 0.933 | 0.741 | 0.692 | 0.309 | 0.0520 | 0.2659 | 0.860 | — | — | — |

Referring to Table 1, each of the reference characters will be described. Specifically, m(kg) represents mass of iron golf club; w(kg) represents mass of weight; wl represents distance from the upper end of grip to the weight; L represents length of the club; L (in) is the length in inches; L(m) is the length in meters; r/L represents the center-of-gravity-ratio; r represents the distance from the upper end of grip to the center of gravity of the golf club; mr (kg·m) represents static moment; Ig (kg·m$^2$) represents inertia moment around the position of center of gravity; I (kg·m$^2$) represents inertia moment around the upper end of grip; I/mr (m) represents the equivalent pendulum length; and Ave is an average value of factor scores for Factor 1, as the comprehensive evaluation of the easiness of swing.

The sensory best represents the number of subjects who put the highest value of factor score for Factor 1, for each club. Referring to Table 1, the number of subjects who put the highest value of factor score for Example 1 was 4. The carbon best represents the number of subjects who put the highest value of factor score related to the easiness of swing of each club having the carbon shaft, excluding the clubs having the steel shaft. Referring to Table 1, when Comparative Example 4 having the steel shaft was excluded, the number of subjects who put the highest value for the factor score for Example 1 was 6.

The subjects were 19 golfers with superior analytical ability. It is noted that for the sensory best, one subject put the same value of factor score for two clubs. Therefore, the subject was counted twice for the two clubs. Therefore, the total number of sensory best is 20.

In the present embodiment, the easiness of swing was evaluated using the SD (Semantic Differential) method and the factor analytic procedure. SD method is for rating an object using a pair of bipolar criteria consisting of opposite adjectives modifying connotative meaning of concepts. In this method, a plurality of subjects (respondents) are asked to determine where his or her position lies on, for example, a scale of 7 levels, between each of the adjectives.

Numerical values are allotted to respective levels of the scale to obtain data in numerical terms, and the data thus obtained is subjected to factor analysis. Thus, a small number of factors are extracted and scores for each factor are obtained. As an introduction to the factor analytic procedure, see, for example, Kanno Kensa Handbook (Sensory Test Handbook), edited by Nikkagiren Kanno Kensa Iinkai (Union of Japanese Scientists and Engineers, sensory test committee), published by Kabushiki Kaisha Nikkagiren Shuppannsha (Union of Japanese Scientists and Engineers Publishing).

In the present embodiment, first, actual hitting test of Examples 1 to 3 and Comparative Examples 1 to 4 was conducted by the subjects. The subjects evaluated each of Examples 1 to 3 and Comparative Examples 1 to 4 on a scale of 7 levels from 1 to 7, of adjective pairs including "favorability" (favorable-unfavorable), "weight" (heavy-light), "easiness of swing" (easy-difficult), "timing" (easy to time-difficult to time), "head movement at impact" (delayed-advanced), "feeling" (good-bad).

The results of factor analysis executed using the results of evaluation by the subjects above are as shown in Table 2. In Table 2, the adjectives mentioned above are described as variables.

TABLE 2

| Variable name | | Factor 1 | Factor 2 |
|---|---|---|---|
| Favorable | Variable1 | 0.936 | 0.032 |
| Light | Variable 2 | 0.007 | 0.992 |
| Easy to swing | Variable 3 | 0.942 | 0.058 |
| Easy to time | Variable 4 | 0.939 | −0.074 |
| Head advanced | Variable 5 | 0.691 | 0.184 |
| Feel good | Variable 6 | 0.947 | 0.031 |
| | Contribution ratio | 0.670 | 0.171 |

Referring to Table 2, Factor 1 of variables "favorable," "easy to swing," "easy to time" and "feel good" has a large value of factor loading. Therefore, the inventors have found that these four variables correspond to the components of "easiness of swing."

Factor 1 of variable "light" has a small value of factor loading, and Factor 2 has a large value of factor loading. Therefore, the inventors have found that the variable "light" does not correspond to the component of "easiness of swing." Further, contribution ratio of Factor 1 is 0.670 and that of Factor 2 is 0.171 and, cumulative contribution ratio of Factors 1 and 2 is about 84.1%. Accordingly, the impression of actual hitting test of iron golf clubs of the present embodiment can be sufficiently explained by Factors 1 and 2.

Factor scores of respective subjects for Examples 1 to 3 and Comparative Examples 1 to 4 were calculated, and an average value of the subjects was calculated. This average value is given as Ave in Table 1.

Figure 2:
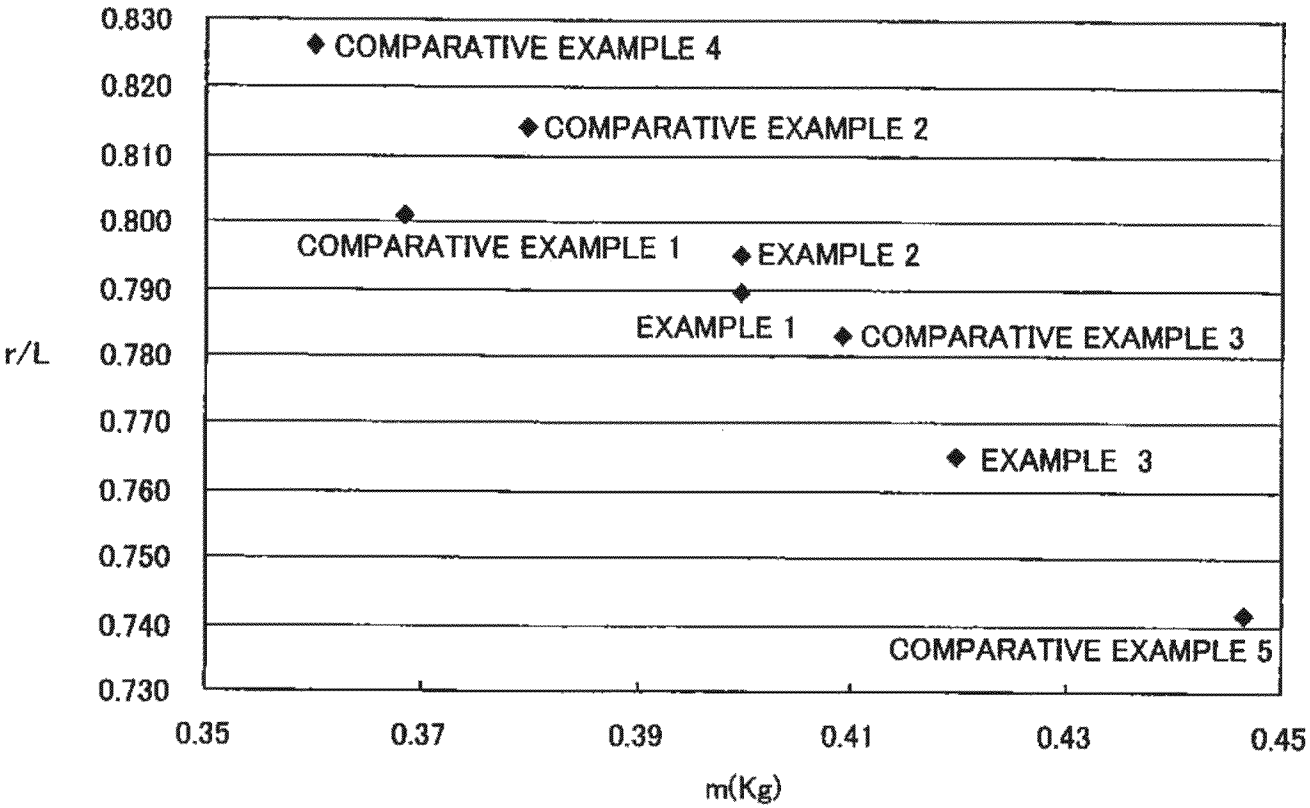
FIG. 2 shows a relation between the center-of-gravity-ratio and the mass of iron golf club in accordance with the embodiment.

Referring to Table 1 and FIG. 2, in Examples 1 to 3, the value Ave was large. From these results, the inventors have found that the easiness of swing can be improved if the mass m (Kg) of iron golf club having a carbon shaft is at least 0.3996 kg and at most 0.4197 kg and the value r/L of center-of-gravity-ratio is at least 0.765 and at most 0.795.

Specifically, the value Ave of Example 2 was particularly high. Therefore, it is found that when the value of r/L center-of-gravity-ratio is at most 0.790, the easiness of swing of an iron golf club can further be improved.

Though the value Ave of Comparative Example 4 was also high, it is noted that Comparative Example 4 had a steel shaft. A golf club having a steel shaft is generally said to be easier to swing than one having a carbon shaft. The value Ave of Example 2 was even higher than Comparative Example 4. Namely, it was found that Example 2 of carbon shaft exhibited improved easiness of swing than the steel shaft.

Figure 3:
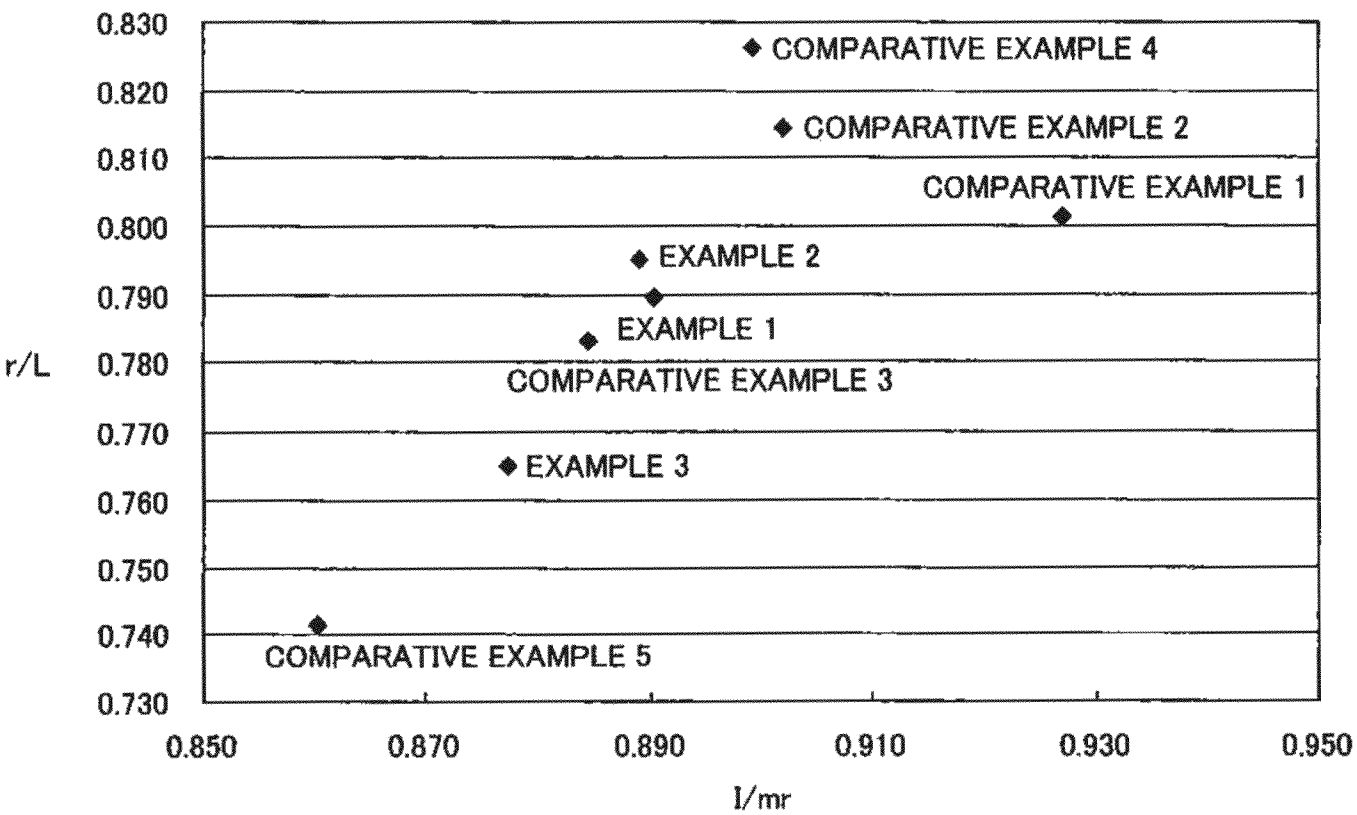
FIG. 3 shows a relation between the center-of-gravity-ratio and the equivalent pendulum length of iron golf club in accordance with the embodiment.

Referring to Table 1 and FIG. 3, in Examples 1 to 3, the equivalent pendulum length (I/mr) was at least 0.877 m and at most 0.890 m. From these results, the inventors have found that the easiness of swing can be improved if the equivalent pendulum length is at least 0.877 m and at most 0.890 m.

When we compare the steel shaft and the carbon shaft, generally, the steel shaft is evaluated to be easier to swing, and this tendency can be seen from Table 1. On the other hand, the carbon shaft has higher damping ratio and eases impact at the time of hitting and, therefore, it has an advantage of preventing fatigue.

When the clubs were evaluated focusing only on those having carbon shafts, most of the subjects who selected the sensory best for the steel shaft selected clubs in accordance with Examples 1 to 3. From these results also, it was found that iron golf clubs of Examples 1 to 3 exhibited improved easiness of swing.

In the present embodiment, thereafter, actual hitting test of Example 3 and Comparative Example 5 was conducted by subjects, in the similar manner as described above. The subjects evaluated each of Example 3 and Comparative Example 5 on a scale of 7 levels from 1 to 7, of adjective pairs including "favorability" (favorable-unfavorable), "weight" (heavy-light), "easiness of swing" (easy-difficult), "timing" (easy to time-difficult to time), "head movement at impact" (delayed-advanced), "feeling" (good-bad). The subjects were 15 golfers with superior analytical ability.

Tables 3 and 4 show the results of factor analysis on the evaluations by the subjects mentioned above. In Table 3, the adjectives are described as variables.

TABLE 3

| Factor score | Factor 1 | Factor 2 |
|---|---|---|
| Example 3 | 0.120 | 0.263 |
| Comparative Example 5 | −0.120 | −0.263 |

TABLE 4

| Factor loading: after loading (varimax) | | |
|---|---|---|
| Variable name | Factor 1 | Factor 2 |
| Favorable | 0.958 | −0.083 |
| Light | −0.069 | 0.473 |
| Easy to swing | 0.952 | 0.203 |
| Easy to time | 0.953 | 0.009 |
| Head advanced | 0.512 | 0.538 |
| Feel good | 0.942 | 0.018 |

Referring to Table 3, Example 3 had higher factor score than Comparative Example 5. From this result, the inventors have found that Example 3 can improve the easiness of swing, as compared with Comparative Example 5.

Further, referring to Table 4, Factor 1 of variables "favorable," "easy to swing," "easy to time" and "feel good" has a large value of factor loading. Therefore, the inventors have found that these four variables correspond to the comprehensive evaluation of "easiness of swing."

Varimax method of Table 4 is a method involving orthogonal rotation to facilitate factor interpretation, in which the factor is rotated to maximize "varimax criteria" defined as the sum of variances of the squared factor loadings modified by communality.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An iron golf club, having a club length L measured in accordance with 60-degrees method of at least 36.5 inches, comprising:

a carbon shaft;

a weight attached to said carbon shaft;

a grip attached to one end of said carbon shaft; and a head attached to the other end of said carbon shaft; wherein sum total of mass of said carbon shaft, said weight, said grip and said head is at least 0.3996 kg and at most 0.4197 kg; and a value r/L, where r represents a distance from an upper end of said grip to the center of gravity of said iron golf club, is at least 0.765 and at most 0.795.

2. The iron golf club according to claim 1, wherein said value r/L is at most 0.790.

3. The iron golf club according to claim 1, wherein equivalent pendulum length of said iron golf club with the upper end of said grip being an axis of rotation is at least 0.877 m and at most 0.890 m.

4. The iron golf club according to claim 1, wherein said value L is at least 36.75 inches.

5. The iron golf club according to claim 1, wherein mass of said weight is at least 20 g and at most 40 g.

* * * * *